US006767268B2

(12) United States Patent
Kao

(10) Patent No.: US 6,767,268 B2
(45) Date of Patent: Jul. 27, 2004

(54) ELECTRICAL LUMINESCENT LAMP PROCESSING METHOD

(76) Inventor: Wen-Ho Kao, No. 31, Hsin Tien Road., Hsin Tien City, Taipei Hsien (TW)

( * ) Notice: Subject to any disclaimer, the term of this patent is extended or adjusted under 35 U.S.C. 154(b) by 75 days.

(21) Appl. No.: 10/153,678

(22) Filed: May 24, 2002

(65) Prior Publication Data

US 2003/0220043 A1 Nov. 27, 2003

(51) Int. Cl.[7] ..... H01J 9/24

(52) U.S. Cl. ..... 445/24

(58) Field of Search ..... 445/24; 313/513–517

(56) References Cited

U.S. PATENT DOCUMENTS 4,853,079 A * 8/1989 Simopoulos et al. ..... 427/68
6,066,830 A * 5/2000 Cline et al. ..... 313/506
6,445,005 B1 * 9/2002 Yamazaki et al. ..... 257/72

* cited by examiner

*Primary Examiner*—Joseph Williams
(74) *Attorney, Agent, or Firm*—Bacon & Thomas

(57) ABSTRACT

An electrical luminescent lamp processing process includes the step of using a machine tool to process a design in the back electrode layer of an electrical luminescent lamp, the step of cutting contact holes in an electrically insulative layer subject to a predetermined design and then adhering the electrically insulative layer to the back electrode layer, and the step of adhering a conductor layer to the electrically insulative layer opposite to the back electrode layer over the contact holes for transmitting electricity to the design in the back electrode layer.

15 Claims, 4 Drawing Sheets

ELECTRICAL LUMINESCENT LAMP PROCESSING METHOD

BACKGROUND OF THE INVENTION

1. Field of the Invention

The present invention relates to an electrical luminescent lamp processing method and, more particularly, to an economic method of fabricating electrical luminescent lamps that have a particular design in the back electrode layer.

2. Description of the Related Art

Electrical luminescent lamps have been intensively used in making advertising sign boards, signal boards, ornamental panels for motor vehicles or buildings, etc. for the advantage of light weight and emitting light without heat. A regular electrical luminescent lamp is generally comprised of a front electrode layer, a luminescent layer, a reflective layer, and a back electrode layer. In order to show a particular design, the front electrode layer, the luminescent layer and the reflective layer are formed by a screen-printing process subject to a predetermined design, and then the back electrode layer is printed on the reflective layer by means of a big screen plate. This screen-printing procedure is not suitable for a small amount production. It is expensive to make a small amount of electrical luminescent lamps showing a particular design by means of screen-printing. When a client orders a particular design of electrical luminescent lamps, the provider shall have to prepare a particular set of screen plates. The cost invested in the particular set of screen plates should be included in the cost of the electrical luminescent lamps.

SUMMARY OF THE INVENTION

The present invention has been accomplished under the circumstances in view. It is therefore the main object of the present invention to provide an electrical luminescent lamp processing method, which is practical and economic to process a particular design in an electrical luminescent lamp. According to one aspect of the present invention, the electrical luminescent lamp processing process comprises the step of using a machine tool to process a design in the back electrode layer of an electrical luminescent lamp, which is comprised of a transparent layer, a front electrode layer, a luminescent layer, a reflective layer, and a back electrode layer. According to another aspect of the present invention, the electrical luminescent lamp processing process further comprises the step of cutting contact holes in an electrically insulative layer subject to a predetermined design and then adhering the electrically insulative layer to the back electrode layer, and the step of adhering a conductor layer to the electrically insulative layer opposite to the back electrode layer over the contact holes for transmitting electricity to the design in the back electrode layer.

DETAILED DESCRIPTION OF THE PREFERRED EMBODIMENT

Figure 1:
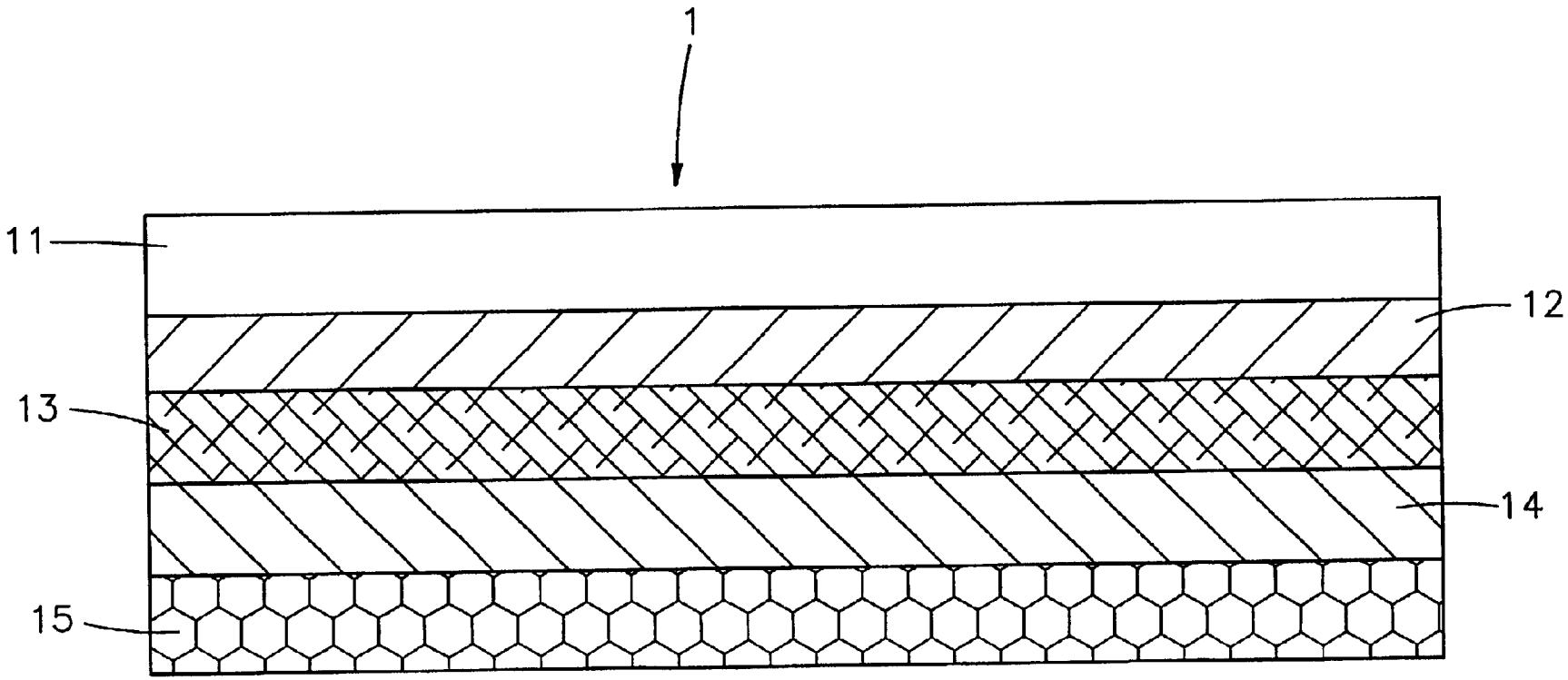
FIG. 1 is a sectional view of an electrical luminescent lamp constructed according to the present invention.
Figure 2:
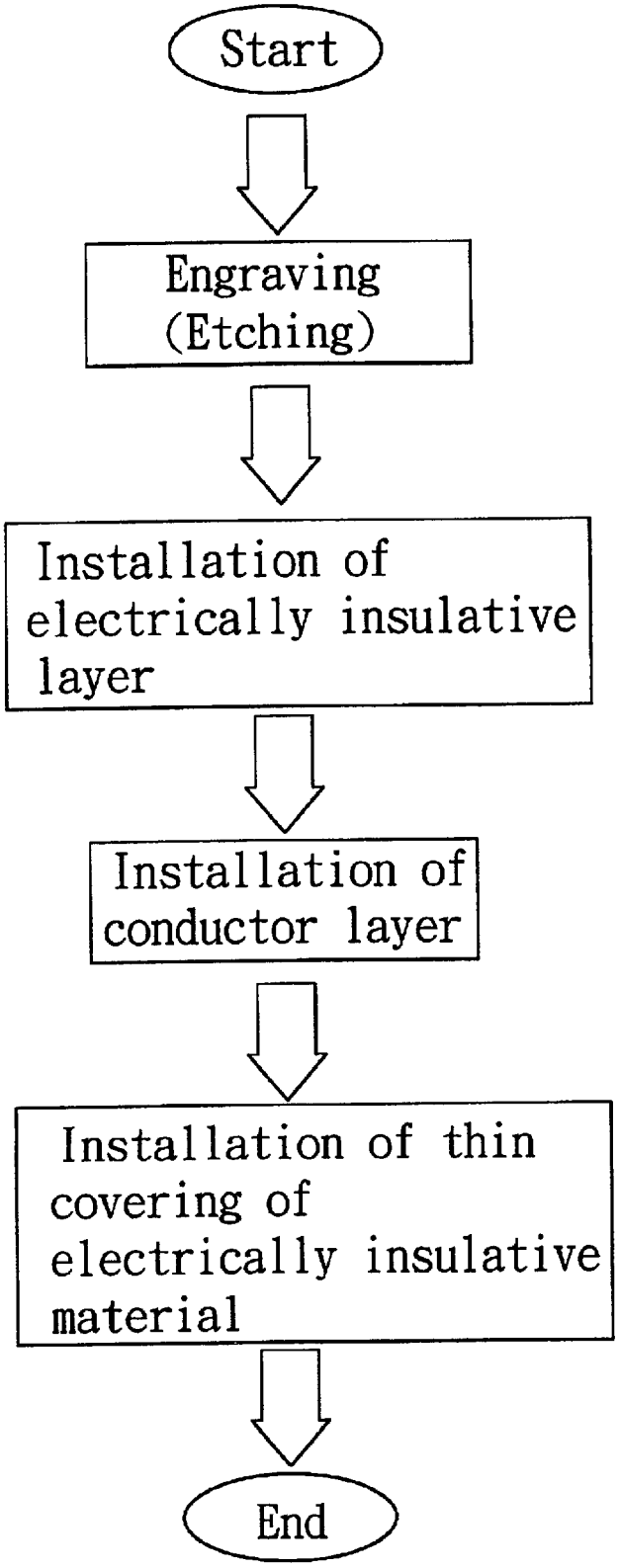
FIG. 2 is a flow chart of the present invention.
Figure 3:
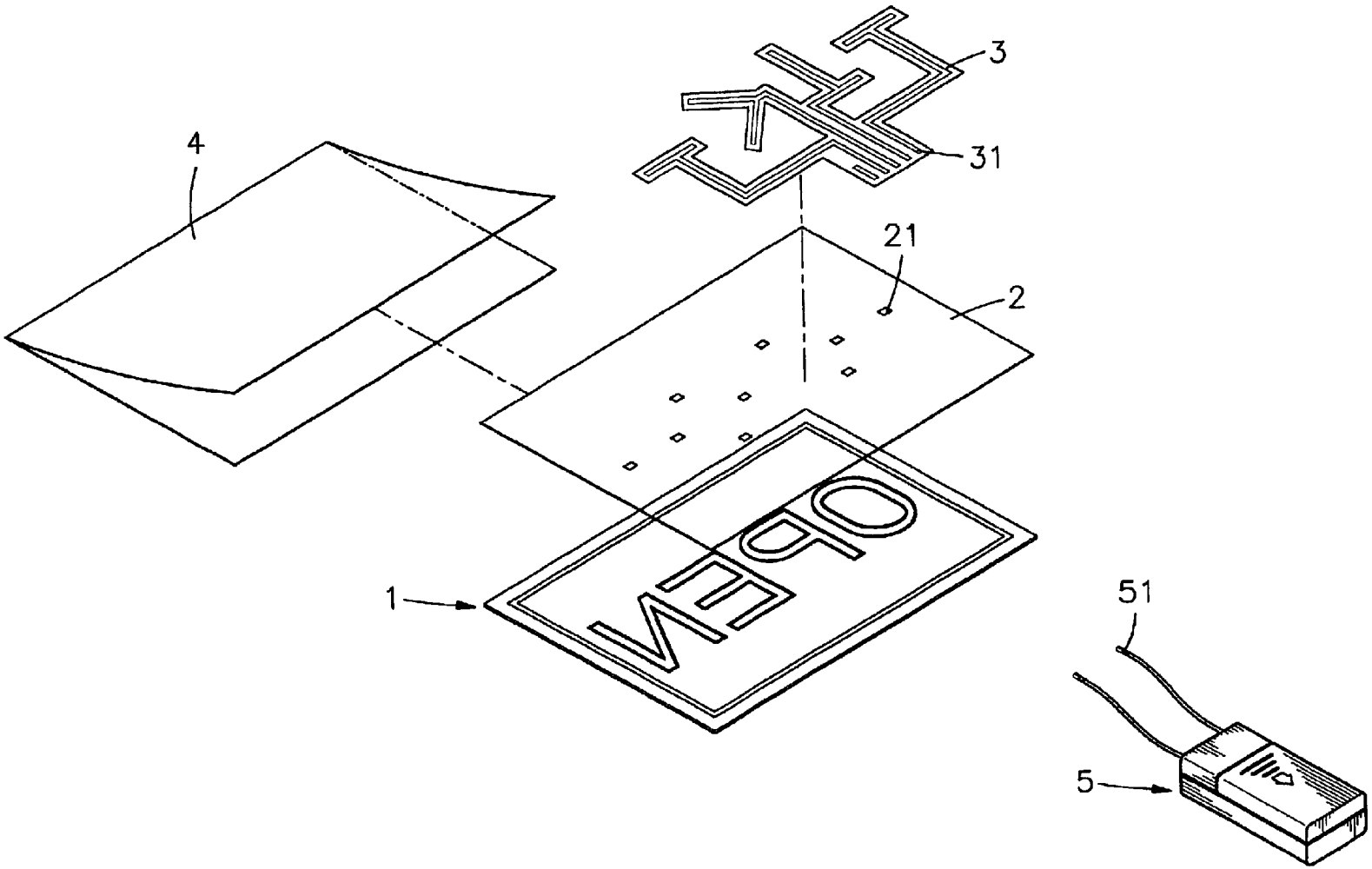
FIG. 3 is an exploded view of the present invention.

Referring to FIGS. 1, 2, and 3, an electrical luminescent lamp 1 is shown comprising in proper order a transparent layer 11, a front electrode layer 12, a luminescent layer 13, a reflective layer 14, and a back electrode layer 15. The front electrode layer 12, the luminescent layer 13, the reflective layer 14, and the back electrode layer 15 are respectively formed on the transparent layer 11 by printing. A machine tool is used to process the back electrode layer 15, forming a particular design in the electrical luminescent lamp 1. The design can be letters, or a pattern. The electrical luminescent lamp 1 thus obtained is further processed through the processing steps of:

1. preparing an electrically insulative layer 2, and then cutting contact holes 21 in the electrically insulative layer 2 subject to a predetermined design, and then adhering the electrically insulative layer 2 to one side of the back electrode layer 15 opposite to the reflective layer 14; and
2. adhering a conductor layer 3 to one side of the electrically insulative layer 2 opposite to the back electrode layer 15, keeping the conductor layer 3 connected to the contact holes 21.

The aforesaid machine tool can be a laser engraving machine controlled to emit a laser beam for engraving the desired letters or pattern in the back electrode layer 15. The operator can control the intensity and caliber of the laser beam during engraving so that the operator can engrave the desired letters or pattern in the back electrode layer 15 subject to the desired depth without cutting through the electrical luminescent lamp 1.

Figure 4:
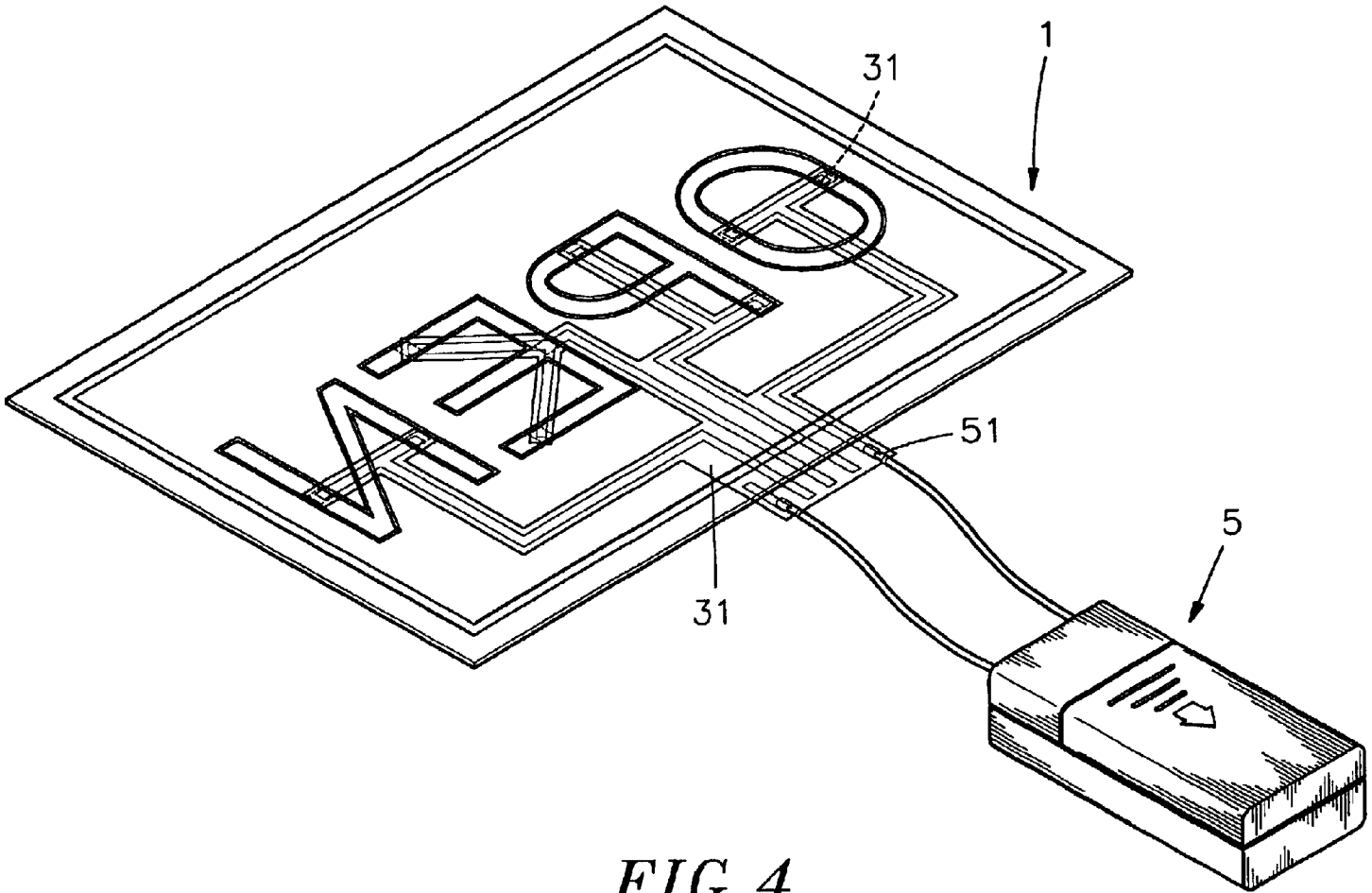
FIG. 4 is a perspective view of the present invention.

Referring to FIGS. 3 and 4, the electrically insulative layer 2 can be a layer of polymeric material or plastic film. The contact holes 21 of the electrically insulative layer 2 are disposed corresponding to the design in the back electrode layer 15 of the electrical luminescent lamp 1. The conductor layer 3 has lead legs 31 connected to the lead-out wires 51 of a power adapter 5. Therefore, the design of the back electrode layer 15 of the electrical luminescent lamp 1 is electrically connected to the power adapter 5 through the conductor layer 3 when the conductor layer 3 installed in the electrical luminescent lamp 1 and connected to the power adapter 5.

Alternatively, a plurality of conductor layers 3 may be adhered to the electrically insulative layer 2 and connected to different parts of the design in the back electrode layer 15 of the electrical luminescent lamp 1, enabling the respective parts of the design in the back electrode layer 15 of the electrical luminescent lamp 1 to be lightened one after another or intermittently lightened subject to a predetermined lighting mode. Furthermore, a thin covering of electrically insulative material 4 may be provided and covered over the conductor layer 3 and the transparent layer 1 of the electrical luminescent lamp 1 for protection. The transparent layer 1 of the electrical luminescent lamp 1 can also be printed with a particular design and adhered with a thin layer of show card of any of a variety of designs and colors.

The aforesaid machine tool for processing a particular design in the back electrode layer 15 of the electrical luminescent lamp 1 can be a laser engraving machine, an etching machine, a cutting machine, or any of a variety of machine tools that can be used to process the desired pattern in the back electrode layer 15 of the electrical luminescent lamp 1. The aforesaid conductor layer 3 can be made of a flexible circuit board, aluminum foil, copper foil, electrically conductive silver paint, or conductor wires. The thin covering of electrically insulative material 4 can be made of transparent or semitransparent film of polymer or plastic film.

As indicated above, the invention achieves the following advantages:

1. The invention is suitable for processing a small amount of electrical luminescent lamps economically to satisfy market requirements.
2. The invention is to directly process the desired design in the back electrode layer without the use of any screen plates.
3. The invention uses a laser engraving machine to directly cut the desired design in the back electrode layer subject to the desired depth without cutting through the electrical luminescent lamp.

A prototype of electrical luminescent lamp fabrication method has been constructed with the features of the annexed drawings of FIGS. 1~4. The electrical luminescent lamp fabrication method functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical luminescent lamp processing process comprising the step of using a machine tool to process a design in the back electrode layer of an electrical luminescent lamp comprised of a transparent layer, a front electrode layer, a luminescent layer, a reflective layer, and a back electrode; and further comprising the step of preparing an electrically insulative layer and then cutting contact holes in said electrically insulative layer subject to a predetermined design and then adhering said electrically insulative layer to one side of said back electrode layer opposite to said reflective layer, and the step of adhering a conductor layer to one side of said electrically insulative layer opposite to said back electrode layer, keeping said conductor layer connected to said contact holes.

2. The electrical luminescent lamp processing process as claimed in claim 1, wherein said machine tool is a laser engraving machine.

3. The electrical luminescent lamp processing process as claimed in claim 1, wherein said machine tool is an etching machine.

4. The electrical luminescent lamp processing process as claimed in claim 1, wherein said machine tool is a cutting machine.

5. The electrical luminescent lamp processing process as claimed in claim 1 further comprising the step of fastening a thin layer of show card to a front side of said transparent layer opposite.

6. The electrical luminescent lamp processing process as claimed in claim 1, wherein said thin layer of show card has a colored design.

7. The electrical luminescent lamp processing process as claimed in claim 1, wherein said electrically insulative layer is made of a plastic film.

8. The electrical luminescent lamp processing process as claimed in claim 1, wherein said contact holes are disposed corresponding to the design in said back electrode layer.

9. The electrical luminescent lamp processing process as claimed in claim 1, wherein said conductor layer is made of material selected from aluminum foil, and electrically conductive silver paint.

10. The electrical luminescent lamp processing process as claimed in claim 1, wherein said conductor layer comprises a plurality of lead legs for power input.

11. The electrical luminescent lamp processing process as claimed in claim 1, wherein said conductor layer is comprises of a plurality of conductor elements respectively adhered to said electrically insulative layer and separated from one another, each having a plurality of lead legs for power input.

12. The electrical luminescent lamp processing process as claimed in claim 1 further comprising the step of covering said conductor layer and said electrical luminescent lamp with a covering of electrically insulative material.

13. The electrical luminescent lamp processing process as claimed in claim 12, wherein said covering of electrically insulative material is made of electrically insulative plastic sheet material.

14. The electrical luminescent lamp processing process as claimed in claim 12, wherein said covering of electrically insulative material is transparent.

15. The electrical luminescent lamp processing process as claimed in claim 12, wherein said covering of electrically insulative material semitransparent.

* * * * *